US008028347B2

(12) United States Patent
Chang

(10) Patent No.: US 8,028,347 B2
(45) Date of Patent: Oct. 4, 2011

(54) HAND PROTECTION STRUCTURE

(75) Inventor: Bruce Chang, Taipei (TW)

(73) Assignee: Philla Industries Inc., Taipei (TW)

( * ) Notice: Subject to any disclaimer, the term of this patent is extended or adjusted under 35 U.S.C. 154(b) by 247 days.

(21) Appl. No.: 12/424,541

(22) Filed: Apr. 16, 2009

(65) Prior Publication Data

US 2009/0307821 A1 Dec. 17, 2009

(30) Foreign Application Priority Data

Jun. 12, 2008 (TW) ..... 97210417 U

(51) Int. Cl.
*A41D 19/00* (2006.01)

(52) U.S. Cl. ..... 2/161.1

(58) Field of Classification Search ..... 2/16, 163, 2/161.1, 161.6, 161.3
See application file for complete search history.

(56) References Cited

U.S. PATENT DOCUMENTS 1,951,190 A * 3/1934 Gambee ..... 2/21
3,732,575 A * 5/1973 Pakulak ..... 2/16
4,272,849 A * 6/1981 Thurston et al. ..... 2/16
4,507,804 A * 4/1985 Consigny ..... 2/21
4,694,508 A * 9/1987 Iriyama et al. ..... 2/21
4,727,862 A * 3/1988 Waddell et al. ..... 602/16
4,766,612 A * 8/1988 Patton, Sr. ..... 2/16
5,113,526 A * 5/1992 Wang et al. ..... 2/2.5
5,911,309 A * 6/1999 Penney ..... 2/16
5,953,751 A * 9/1999 Kobren ..... 2/16
6,557,177 B2 * 5/2003 Hochmuth ..... 2/159
6,684,406 B2 * 2/2004 Fowler ..... 2/16
6,813,781 B2 * 11/2004 Wilder et al. ..... 2/161.1
6,918,137 B2 * 7/2005 Fowler ..... 2/16
7,143,447 B2 * 12/2006 Fleischmann ..... 2/16
7,293,296 B1 * 11/2007 Beraznik et al. ..... 2/161.1
7,320,145 B2 * 1/2008 Hochmuth et al. ..... 2/161.1
7,478,440 B2 * 1/2009 Dolenak ..... 2/161.6
7,574,748 B2 * 8/2009 Fisher et al. ..... 2/16
7,784,110 B2 * 8/2010 Jourde et al. ..... 2/161.1
7,797,758 B2 * 9/2010 Keppler et al. ..... 2/21
7,802,315 B2 * 9/2010 Contant et al. ..... 2/161.1
2004/0148675 A1 * 8/2004 Powell ..... 2/16
2007/0083968 A1 * 4/2007 Stokes ..... 2/16
2007/0226866 A1 * 10/2007 Geyer et al. ..... 2/16
2008/0052799 A1 * 3/2008 Yoo ..... 2/16

* cited by examiner

*Primary Examiner* — Danny Worrell

(57) ABSTRACT

A hand protection structure is provided. The hand protection structure includes a fixing unit, a plurality of finger protection units, a plurality of fingertip members, and a plurality of backbone members. The finger protection units are configured of flat strip shapes. Each of finger protection units has one fingertip member assembled at a distal end thereof, and a fastening piece is configured at the end thereof of the finger protection unit for mounting the finger protection unit to the fixing unit. The hand protection structure can be assembled in a glove. When a hand of the user is impacted by external forces, the finger protection units relieve the external impact to protect the fingers from injury.

10 Claims, 8 Drawing Sheets

HAND PROTECTION STRUCTURE

BACKGROUND OF THE INVENTION

1. Field of the Invention

The present invention relates generally to a hand protection structure, and more particularly, to a hand protection structure adapted to be assembled in a glove for providing a buffer to user's hands and protecting the hands from being injured by external impact or press.

2. The Prior Arts

FIG. 1 illustrates a glove having a conventional hand protection structure. As shown in FIG. 1, a glove 10 includes a palm portion and several finger portions, i.e., thumb, forefinger, middle finger, ring finger, and little finger, which extend from an end edge of the palm portion. An opening portion is configured at the opposite end edge of the palm portion, for allowing a user to put in his hand. A non-skid layer (not shown in the drawing) is provided at a front side of the glove. A hand protection member 101 is assembled inside the glove 10. The hand protection member 101 has a certain elasticity, and is configured to extend from the palm portion to each of the finger portions. When wearing such a glove 10, the user can adjust the width of the opening in accordance with the size of his wrist by adjusting a VELCRO hook and loop fastener 102 disposed at a peripheral of the opening.

When working or doing exercises, the hand may be accidentally injured by an external impact, especially, finger fractures or strains caused by reverse bending of the fingers. However, when wearing such a glove 10, the hand protection member 101 provides a buffer to relieve the external impact applied to fingers. In other words, the hand protection member 101 is adapted to eliminate the external impact to the fingers by slightly reverse bending. However, such a conventional hand protection member 101 of the glove 10 is usually made of soft materials such as plastic and rubber, which may be caused with elasticity fatigue after a long time use, so that the user is unconsciously put at risk of being gradually injured by the external impact. Therefore, the conventional hand protection member 101 of the glove 10 is desired to be further improved.

SUMMARY OF THE INVENTION

A primary objective of the present invention is to provide a hand protection structure assembled in a glove, adapted for providing a buffer to reduce the injury caused by an external impact.

For achieving the foregoing objective, the present invention provides a hand protection structure, which includes a fixing unit, a plurality of finger protection units, a plurality of fingertip members, and a plurality of backbone members. The finger protection units are configured of flat strip shapes. Each of the finger protection units is assembled with one fingertip member at a distal end thereof, and a fastening piece is configured at the other end of the finger protection unit for mounting the finger protection unit to the fixing unit. A plurality of assembling slots are configured at a surface of the finger protection unit between the fastening piece and the fingertip member. Each assembling slot can be assembled with one backbone member with a certain space maintained therein. The assembling slot is configured with a relief portion. The relief portion has a thickness smaller than that of the rest area of the finger protection unit, and presents a better elasticity than the rest area of the finger protection unit.

The hand protection structure can be assembled in a glove. When the hand is impacted by external forces, the finger protection units relieve the external forces, in which the finger protection units bend toward a reverse bending direction of the fingers by the elasticity of the relief portions until all remained space of the assembling slots are completely filled and the backbone members are compactly combined. Meanwhile, each two adjacent backbone members are also compactly combined against each other for maintaining the shape of the finger protection units, which restricts the finger from further bending toward the reverse bending direction, thus relieving the external impact and providing protection to the fingers.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
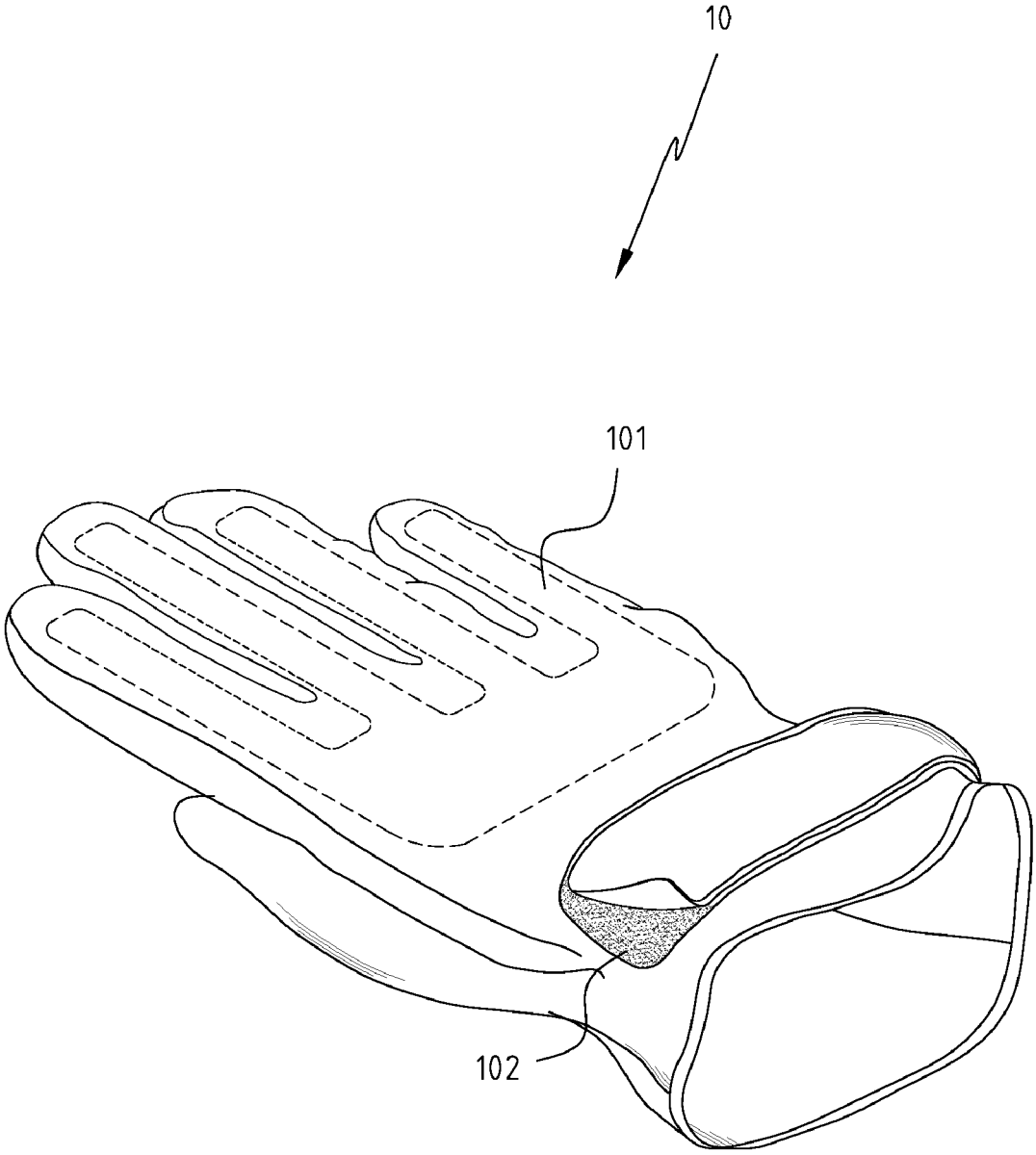
FIG. 1 is a perspective view of a glove having a conventional hand protection structure.
Figure 2:
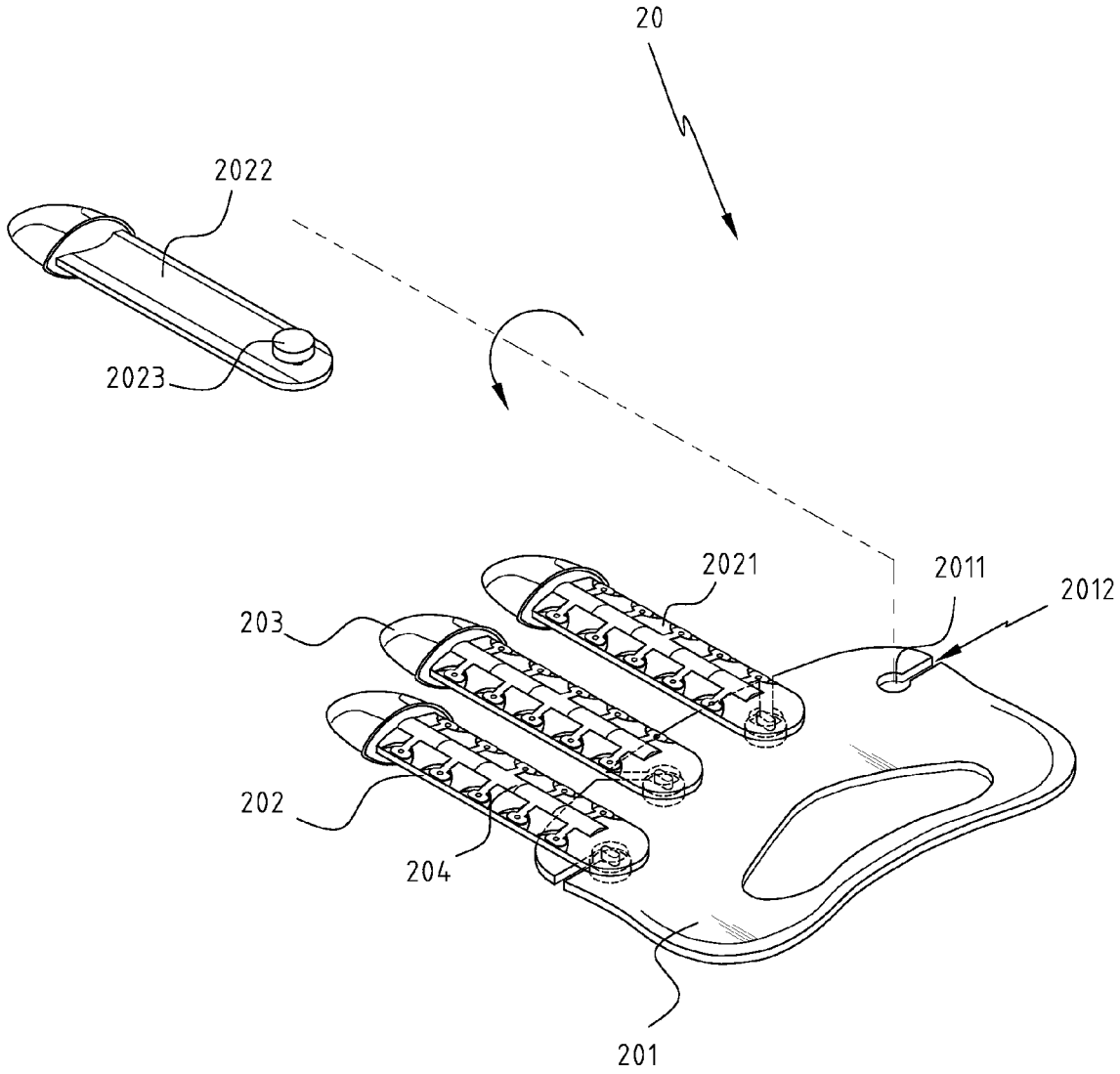
FIG. 2 is a perspective view of a hand protection structure according to a first embodiment of the present invention.
Figure 3:
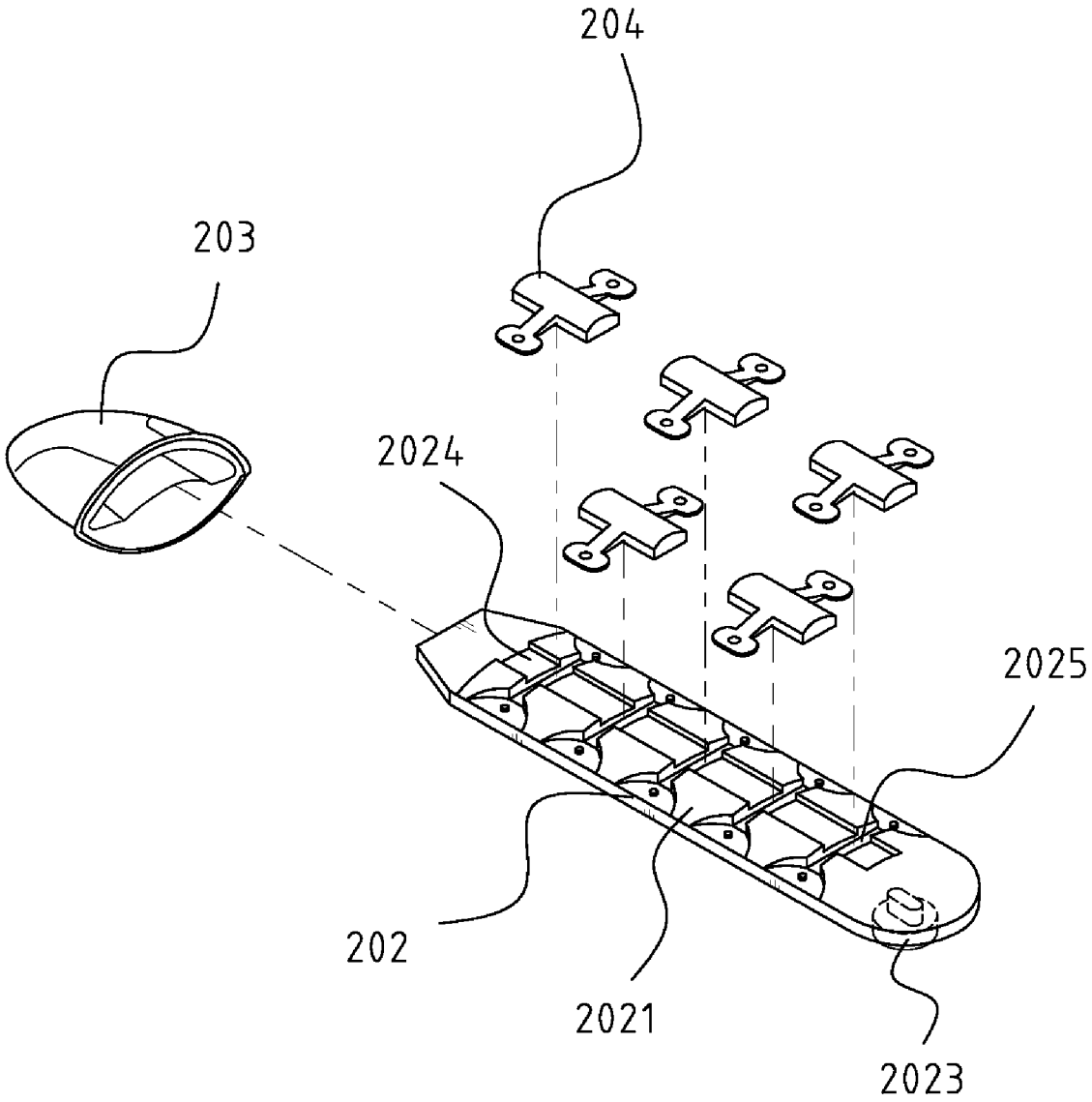
FIG. 3 is an exploded view showing a finger protection unit of the hand protection structure according to the first embodiment of the present invention.

FIG. 2 is a perspective view of a hand protection structure 20 in accordance with a first embodiment of the present invention. Referring to FIG. 2, the hand protection structure 20 includes a fixing unit 201, a plurality of finger protection units 202, a plurality of fingertip members 203, and a plurality of backbone members 204. The fixing unit 201 is configured with a flat plate shape having a plurality of mounting holes 2011 configured at a surface thereof. Each mounting hole 2011 is configured with a slide channel 2012 extending from the mounting hole 2011 to a peripheral edge of the fixing unit 201. Each of the finger protection units 202 is configured with a flat strip shape having a first bending plane 2021 and a second bending plane 2022. Each of the finger protection units 202 is assembled with one fingertip member at a distal end thereof, and a fastening piece 2023 is configured on the second bending plane 2022 at the other end of the finger protection unit. The finger protection unit 202 is mounted to the mounting hole 2011 by the fastening piece 2023 along the slide channel 2012 of the fixing unit 201. FIG. 3 is an exploded view of the finger protection structure 202 in accordance with the first embodiment of the present invention. Referring to FIGS. 2 and 3 together, each finger protection unit 202 includes a plurality of assembling slots 2024 arranged in parallel on the first bending plane 2021. Each assembling slot 2024 is communicable with a next assembling slot 2024 adjacent thereto. Each assembling slot 2024 is provided for receiving a backbone member 204 with a certain space maintained. The backbone member 204 and the finger protection unit 202 can be assembled together like backbones of vertebrates. Further, the assembling slot 2024 is configured with a relief portion 2025 therein. The relief potion 2025 has a thickness smaller than that of the rest area of the finger protection unit 202. As such, the relief portion 2025 presents a better elasticity than the rest area of the finger protection unit.

Figure 4:
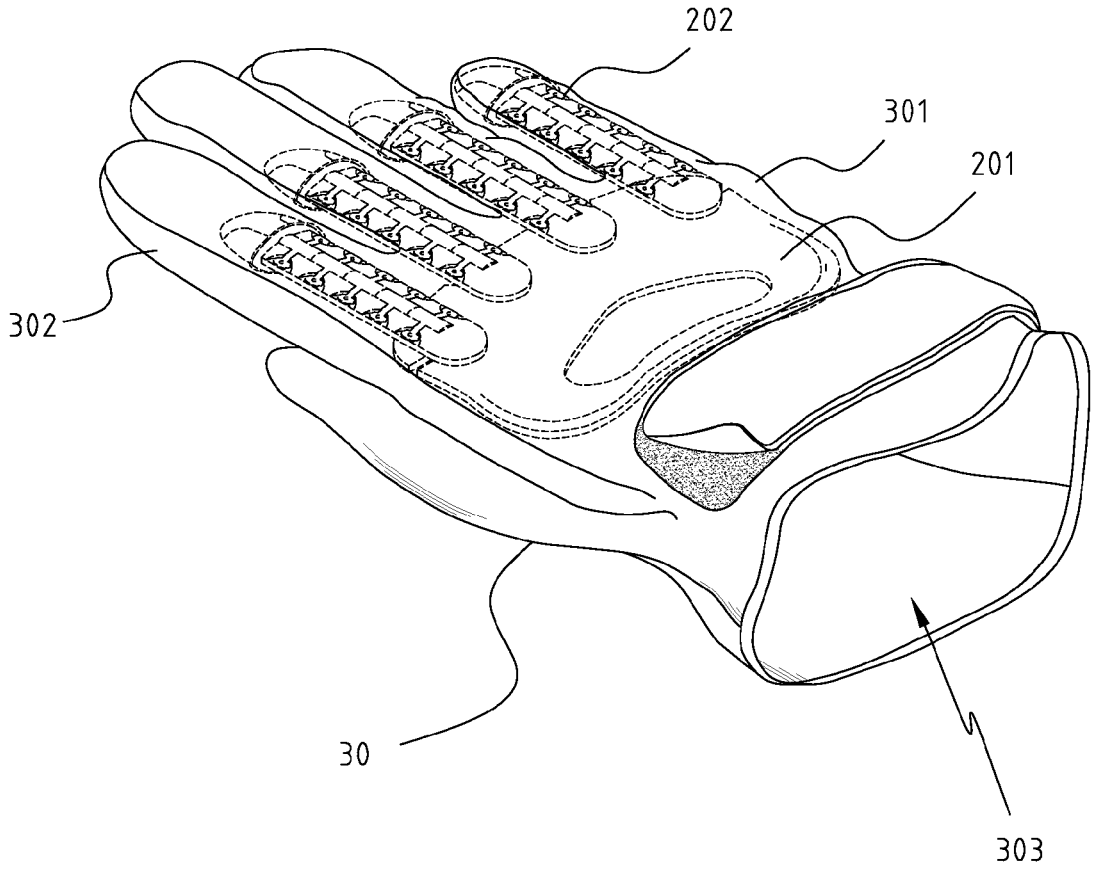
FIG. 4 is a schematic view showing the hand protection structure assembled in a glove according to the first embodiment of the present invention.

FIG. 4 is a schematic view illustrating the hand protection structure in accordance with the first embodiment of the present invention. Referring to FIG. 4, the hand protection structure 20 is adapted to be assembled in a glove 30. The fixing unit 201 of the hand protection structure 20 is assembled in a palm portion 301 of the glove 30. A plurality of finger portions 302, i.e., forefinger, middle finger, ring finger, etc., extend from an end of the palm portion 301. Each of the finger portions 302 is assembled with one finger protection unit 202 therein. An opening portion 303 is configured at the other end of the palm portion 301. The opening portion 303 is preferably provided with a VELCRO hook and loop fastener or an elastic fastening buckle member for adjusting the width of the opening portion 303 according the size of user's wrist. By wearing such a glove 30, the fingers of the user can be instantly protected by elastic support of the finger protection units 202 when the hand of the user is impacted by an external force, and the external impact is transferred from the fingers to the finger protection units 202 and is relieved thereby. Further, the fingertip members 203 assembled at the ends of the finger protection units 202 are disposed in the distal ends of the finger portions 302 of the glove 30. The fingertip members 203 are featured in having a thickness greater than that of the rest area of the finger protection units 202. As such, the distal ends of the finger portions 302 of the glove 30 can be slightly spatially filled for maintaining the sensitivity of the user's fingertips.

Figure 5:
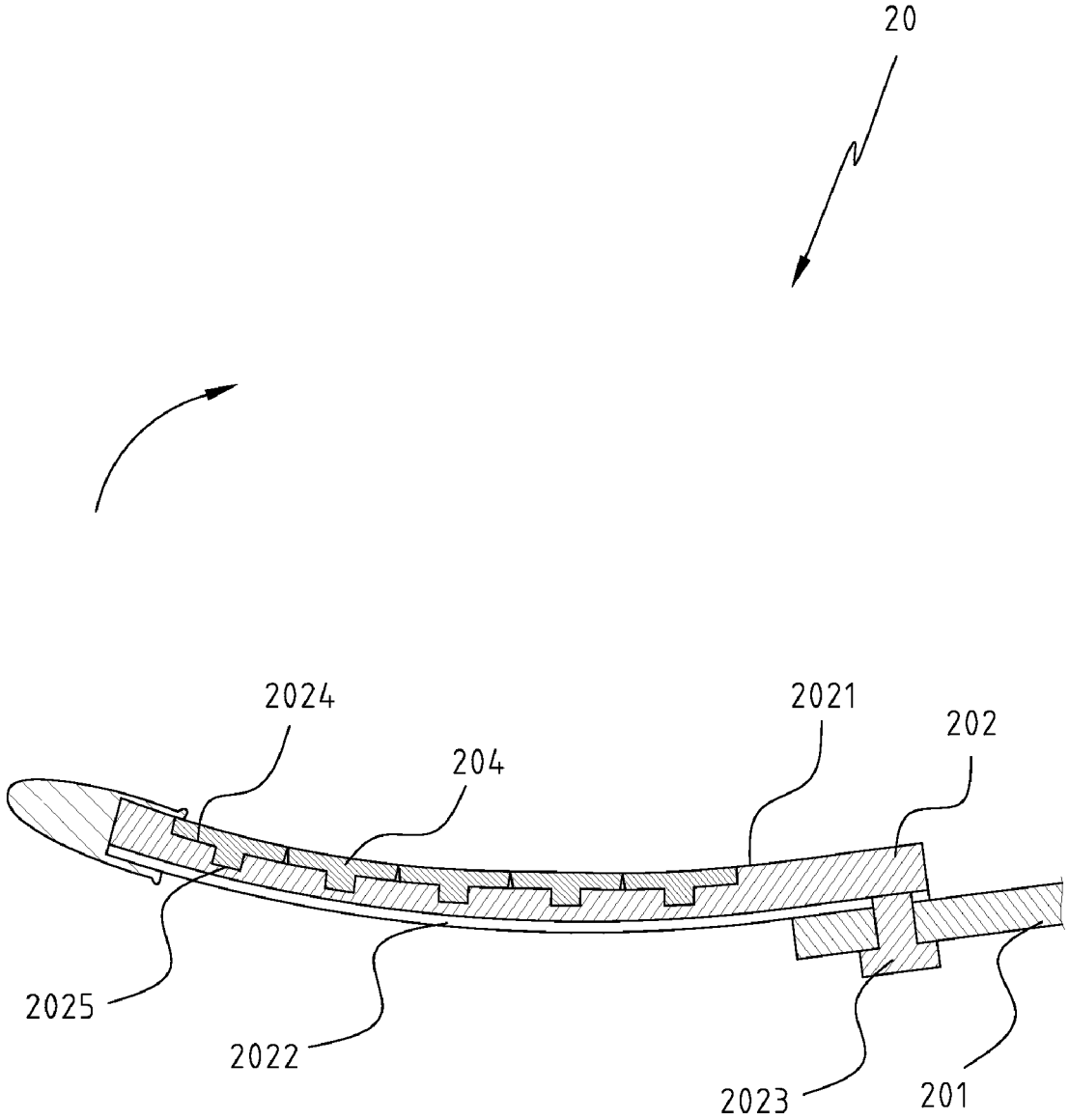
FIG. 5 is a side view illustrating a reverse bending situation of the hand protection structure according to the first embodiment of the present invention.

FIG. 5 is a side view illustrating a reverse bending situation of the hand protection structure in accordance with the first embodiment of the present invention. Referring to FIG. 5 and FIG. 3 together, when the hand is impacted by an external force, the first bending plane 2021 of the finger protection unit 202 of the hand protection structure 20 bends toward a reverse direction of a bending direction of user's fingers. At the same time, a part of external force is transferred to the finger protection units 202 and relieved therein. In this process, the elastic forces between the relief portions 2025 of the finger protection units 202 allow the finger protection units 202 to bend reversely, which drives two opposite ends of the assembling slots 2024 to approach one to another until the two opposite ends bear against the backbone member 204. In this case, the backbone member 204 are pressed and pushed by the assembling slots 2024, and thus being compactly combined with a next backbone member 204 adjacent thereto, similar to the backward bending action of the backbone of a vertebrate and thus maintaining the shape of the finger protection units 202. In such a way, the first bending plane 2021 and the fingers are restricted from being further reversely bent, and the fingers are thus well protected from being injured by the external impact.

Figure 6:
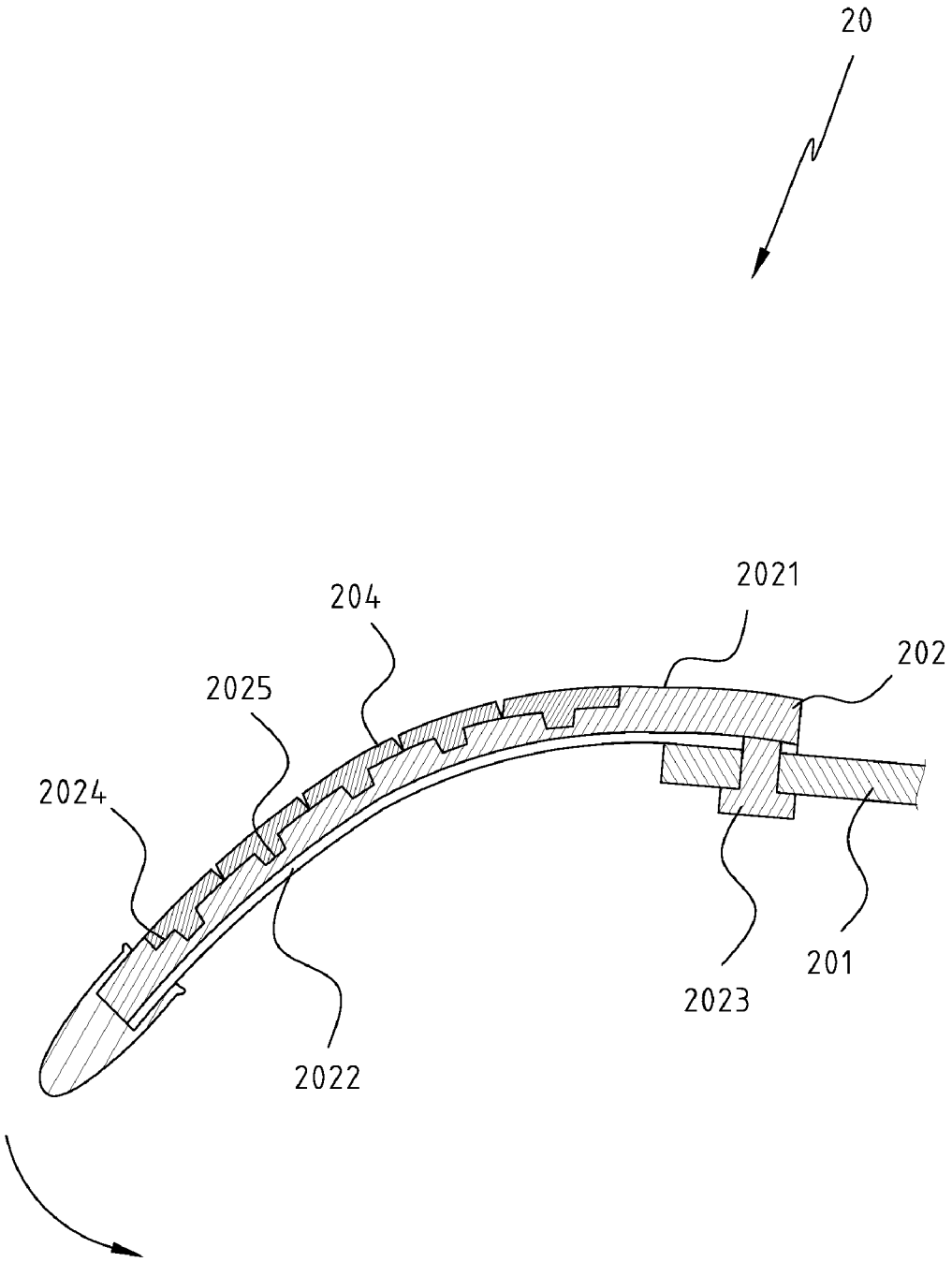
FIG. 6 is a side view illustrating a forward bending situation of the hand protection structure according to the first embodiment of the present invention.

FIG. 6 is a side view illustrating a forward bending situation of the hand protection structure in accordance with the first embodiment of the present invention. Referring to FIG. 6 and FIG. 3 together, in usual, the user's hand is bent forward, i.e., as for grasping. In this process, the elastic forces between the relief portions 2025 of the finger protection units 202 allow the finger protection units 202 to bend forward as well, which drives the two opposite ends of the assembling slot 2024 to separate apart one from another, and the space remained between the backbones 204 is increased. In this case, the finger protection units 202 can be freely bent forward along with the bending of the fingers with a curvature greater than that of the reverse bending of the finger protection units 202. It is so because when reverse bending, the two opposite ends of the assembling slot 2024 are restricted against the backbone member 204 and thus being not allowed for further bending, while when forward bending, the two opposite ends of assembling slot 2024 can be unrestrictedly stretched according to the bending of the user's fingers.

Figure 7:
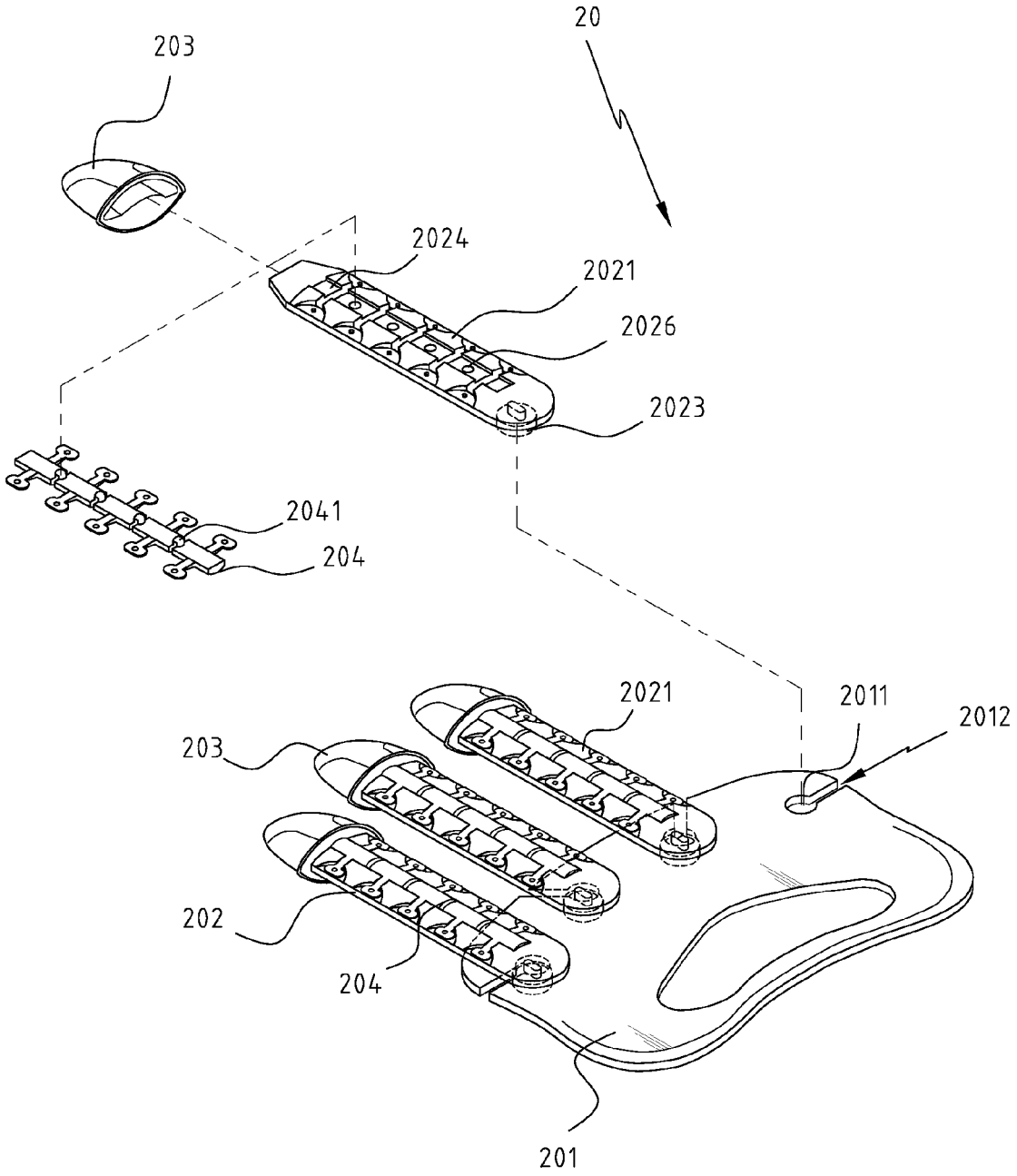
FIG. 7 is a perspective view of a hand protection structure according to a second embodiment of the present invention.

FIG. 7 is a perspective view of a hand protection structure in accordance with a second embodiment of the present invention. Referring to FIG. 7, a joint 2041 is further configured between each two adjacent backbone members 204. The joint 2041 is configured with a cutting groove at a center surface thereof for allowing the two backbone members 204 to close toward or separate apart from each other. The joint 2041 is positioned relatively higher than other area of the backbone 204 and is protruded from a surface of the backbone members 204. The joint 2041 is configured corresponding to a fixing slot 2026 at a surface of the finger protection unit 202 between each two adjacent relief portions 2025. When the backbone members 204 are assembled to the finger protection units 202, the joints 2041 are disposed in the fixing slots 2026 for improving the stability of the backbone members 204 relative to the finger protection units 202. By employing such a relationship between the joints 2041 and the fixing slots 2026, the backbone members 204 are less likely to drop off.

Figure 8:
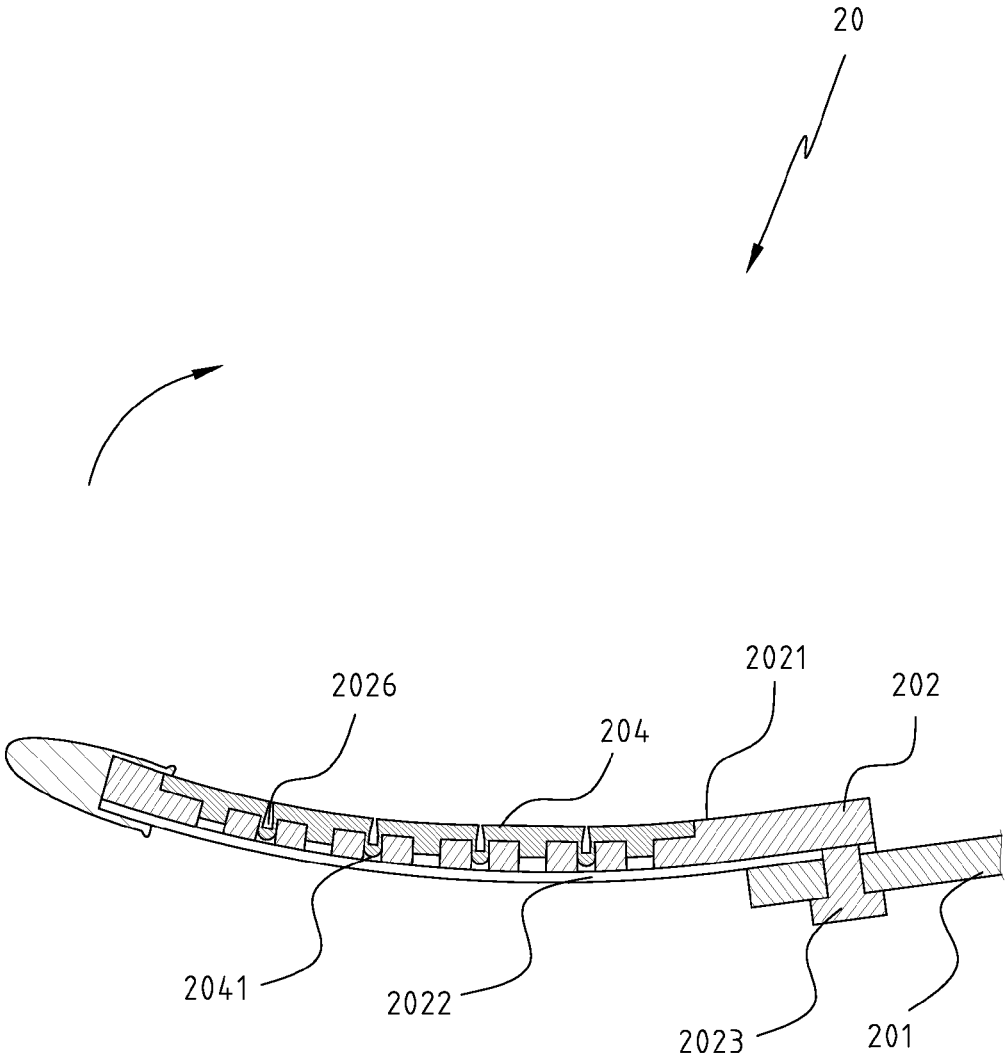
FIG. 8 is a side view illustrating a reverse bending situation of the hand protection structure according to the second embodiment of the present invention.

FIG. 8 is a side view illustrating a reverse bending situation of the hand protection structure in accordance with the second embodiment of the present invention. Referring to FIG. 8, when the user is impacted by an external force, the first bending plane 2021 and the second bending plane 2022 of the finger protection units 202 bend reversely according to the reverse bending of the fingers. In this case, each two adjacent backbone members 204 combine more compactly to maintain the fingers bending to a suitable degree. In addition, the joints 2041 provided between each two adjacent backbone members 204, are further adapted for allowing the two backbone members 204 to close toward or separate apart from each other in the fixing slot 2026, for further improving the stability of maintaining the fingers bending to a suitable degree.

Generally, the present invention provides a hand protection structure, adapted to be assembled in a glove. When a user wears such a glove, the finger protection units of the hand protection units provide a buffer to the user's hand and protect the hand from being injured by reverse bending of the fingers when the hand is impacted by an external force.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A hand protection structure, comprising:

a fixing unit;

a plurality of finger protection units, each of the finger protection units assembled to the fixing unit at one end thereof, and defining a first bending plane and a second bending plane, wherein the first bending plane is configured with a plurality of assembling slots; and a plurality of backbone members, adjacently disposed in the assembling slots with a certain space maintained between every two adjacent backbone members to allow and restrict bending of the first bending plane, wherein interference against each other between adjacent backbone members restricts a bending degree of the first bending plane, without restricting a bending degree of the second bending plane.

2. The hand protection structure according to claim 1, wherein each of the finger protection units further has a fingertip member configured at the other end thereof.

3. The hand protection structure according to claim 2, wherein the fixing unit is of a flat plate shape.

4. The hand protection structure according to claim 1, wherein the fixing unit has a plurality of mounting holes at a surface thereof.

5. The hand protection structure according to claim 4, wherein each of the mounting holes has a slide channel extending from the mounting hole to an edge of the fixing unit.

6. The hand protection structure according to claim 4, wherein each of the finger protection units has a fastening piece configured at the end assembled to the fixing unit.

7. The hand protection structure according to claim 1, wherein the assembling slot of the finger protection unit is configured with a relief portion therein.

8. The hand protection structure according to claim 1, wherein a joint point is configured at each two adjacent backbone members.

9. The hand protection structure according to claim 8, wherein the joint point is protruded from a surface of the backbone members, corresponding to a fixing slot configured at a surface of the finger protection unit.

10. The hand protection structure according to claim 8, wherein the jointing point has a cutting groove configured at a center surface thereof for allowing the two adjacent backbone members to close toward or separate apart from each other.

* * * * *